United States Patent [19]

Tabuchi

[11] 4,214,868

[45] Jul. 29, 1980

[54] METHOD OF AND AN APPARATUS FOR SOAKING STEEL PIECES

[75] Inventor: Seigo Tabuchi, Narashino, Japan

[73] Assignee: ITOH Iron & Steel Works Co. Ltd., Tokyo, Japan

[21] Appl. No.: 963,829

[22] Filed: Nov. 27, 1978

[30] Foreign Application Priority Data

Jun. 21, 1978 [JP] Japan ..... 53-75220

[51] Int. Cl.[3] ..... F27B 9/14

[52] U.S. Cl. ..... 432/124; 432/133; 432/11; 432/246

[58] Field of Search ..... 432/11, 121, 124, 128, 432/130, 133, 143, 155, 163, 164, 170, 177, 188, 190, 212, 246

[56] References Cited

U.S. PATENT DOCUMENTS

| | | | |
|---|---|---|---|
| 2,329,211 | 9/1943 | Morton | 432/11 |
| 2,430,477 | 11/1947 | Morton | 432/11 |
| 2,697,860 | 12/1954 | Anthony | 432/124 |
| 3,172,647 | 3/1965 | Remmey | 432/145 |
| 3,361,418 | 1/1968 | Fromont et al. | 432/124 |
| 3,599,944 | 8/1971 | Erikson | 432/124 |
| 3,801,267 | 4/1974 | Okuno et al. | 432/133 |
| 3,841,614 | 10/1974 | Okuno | 432/133 |
| 3,905,758 | 9/1975 | Moussou et al. | 432/11 |
| 4,047,886 | 9/1977 | Heyraud | 432/128 |

*Primary Examiner*—Henry C. Yuen

[57] ABSTRACT

A heated soaking furnace, a chamber for preheating cold steel pieces in communication with said soaking furnace, means for transferring a portion of the heat from the furnace to the chamber, means for moving the steel pieces through the chamber to preheat the steel pieces and means for conveying the steel pieces from the outlet of the chamber to the inlet of the furnace.

9 Claims, 8 Drawing Figures

METHOD OF AND AN APPARATUS FOR SOAKING STEEL PIECES

BACKGROUND OF THE INVENTION

This invention relates to a method and an apparatus for soaking steel, in which cold steel pieces stored outside the arrangement are subjected to a prehating treatment and subsequently to a soaking treatment with or without hot steel peces delivered from an ingot-making position.

Hitherto, the steel making furnace such as a converter, an open-hearth furnace, an electric furnace or the like has been operated in a batch-wise manner, so that different sorts of steel pieces have been discontinuosuly produced in the cogging factory. On the contrary, since the rolling mill is operated continuously, the soaked steel pieces must be always supplied continuously to the rolling mill. Thus, some of the excess steel pieces must be temporarily stored outside the arrangement, and an appropriate control of cooling and reheating of such the excess steel pieces is extremely difficult, which seriously affects to quality and yield of the products in the subsequent rolling mill as well as the manufacturing capacity in the continuous operation. Furthermore, so-called the walking-beam furnace is known as a furnace useful for the soaking treatment, which is designed to reheat the cold steel pieces passed through the cooling treatment. The furnace of this type has the disadvantages that its heating capacity must be large that the furnace inevitably includes movable components at high operational costs and thus is not tolerable with a labor-saving purpose.

SUMMARY OF THE INVENTION

It is therefore a general object of the invention to eliminate the foregoing disadvantages and inconveniences and to provide an improved soaking treatment with a high heat efficiency.

In one aspect of the invention, there is provided a method of soaking steel pieces in the soaking furnace comprising the steps of providing a chamber in communication with the soaking furnace, transferring a portion of the heat from the soaking furnace to the chamber, moving cold steel pieces through the chamber to preheat the same, and thereafter passing the preheated pieces into the soaking furnace.

The foregoing steps preferably includes the steps of rotating the cold steel pieces during movement through the chamber and into the soaking furnace to expose different surfaces of the pieces to the heat, feeding the cold steel pieces to the chamber in a continuous streatm, feeding hot steel pieces directly from an ingot forming mechanism to the soaking furnace, selectively interspersing therewith the preheated pieces and changing the direction of movement of the cold steel piece while being moved through the chamber and to the soaking furnace.

In another aspect of the invention, there is provided an apparatus for soaking steel pieces comprising a heated soaking furnace having an inlet, an outlet, and troughs for guiding the pieces through the furnace, a chamber for preheating cold steel pieces, means for transferring at least a portion of the heat from the furnace to the chamber which has an inlet for receiving cold pieces, means for moving the cold pieces through the chamber to preheat the same and an outlet in communication with the inlet of the furnace, means for conveying the preheated pieces from the outlet of the chamber to the inlet of the furnace, whereby the pieces are introduced in preheated condition to the furnace.

The means for transferring the heat from the furnace to the chamber comprises a flue for the exhaust heat of the furnace.

The means for conveying the preheated pieces from the outlet of the chamber to the inlet of the soaking furnace comprises a roller-table located at the outlet of the chamber for receiving and moving the preheated pieces, a rotation means provided at the outlet of the preheating chamber for rotating each prehated piece prior to deposition on the conveyor means, another rotation means interposed between the end of the conveyor means and the inlet to the furnace for further rotating each prehated piece about its axis, and transfer means for moving the preheated pieces into the inlet of the furnace.

The conveyor means extends normal to the direction of movement of the pieces through the preheating chamber and the transfer means extends perpendicular to the movement of the pieces through the soaking furnace.

Further, the conveyor means is located in plane stepped down from the plane of the chamber and in a plane stepped up from the transfer means, and the rotation means for rotating the pieces includes at least in part the outlet edge of the chamber and the edge of the conveyor means, respectively, rotates the piece by 90°.

The transfer means is in communication with a feed roller table for supplying hot ingots and for selectively interspersing the preheated pieces with the hot ingots. Further, the transfer means comprises a crossfeed mechanism which is comprised of a feed frame having an upper surface at the same level of the surface of the movable conveyor and a plurality of driven transfer lines movable normally to the direction of movement of the pieces in the soaking furnace, and each of the transfer lines has a plurality of foldable chain hooks engageable with the pieces.

The soaking furnace is provided with a heating source in the side walls thereof and corrugated bed defining a plurality of longitudinal troughs in which the pieces are moved and which are trapezoidal in cross section.

In accordance with the invention, the arrangement further includes a charging means which comprises a rail frame, a vehicle movably mounted on the rail frame, pusher-heads swingably attached to the front of said vehicle for passing the steel pieces through the soaking furnace, a swing mechanism for swing the pusher-heads up and down, and a driving mechanism mounted on the vehicle for moving the same.

In the specification, the term "crossfeed" signifies that the steel piece is moved with its central axis in normal to the direction of movement of the steel piece.

In accordance with the present invention, the cold steel pieces stored outside the arrangement are preheated in the preheating chamber and then successively subjected to the soaking treatment together with or without the hot steel pieces delivered from the ingot-making position and thereafter the soaked steel pieces are continuously supplied to the rolling mill with the following advantages.

(a) The well-balanced stream of the steel pieces is achieved among the ingot-making, the soaking and the rolling operations.

(b) The production capacity is increased.
(c) The effective utilization of a heat energy is expected because a portion of the heat from the soaking furnace is utilized for the preheating chamber.
(d) The running cost as well as the labor-consumption is reduced.
(e) The production of the oxidized scales is suppressed.

Other objects and advantages of the present invention will be readily apparent and understood from the following description and the accompanying drawings, in which:

BRIEF DESCRIPTION OF THE INVENTION

DESCRIPTION OF THE PREFERRED EMBODIMENTS

Figure 3:
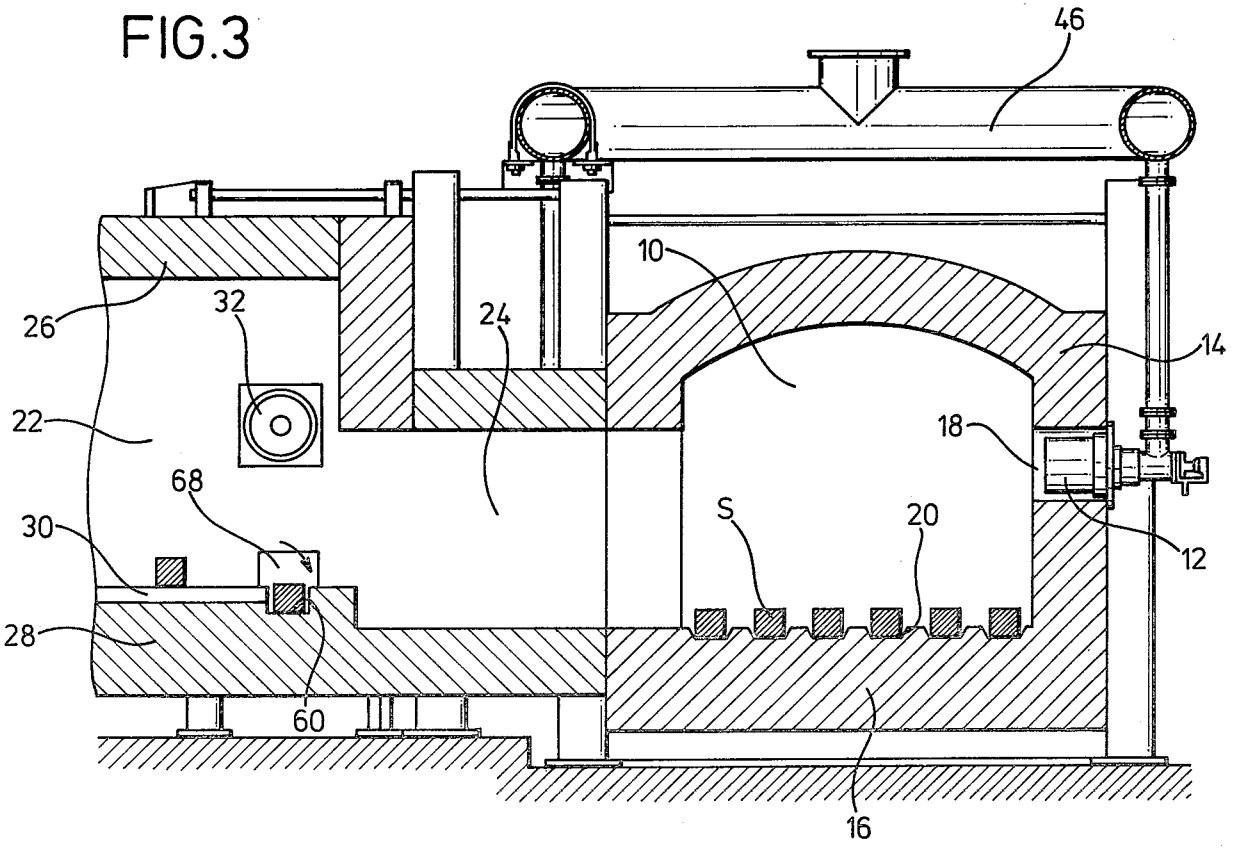
FIG. 3 is a cross sectional view of the soaking furnace with the small flue and the preheating chamber.
Figure 4:
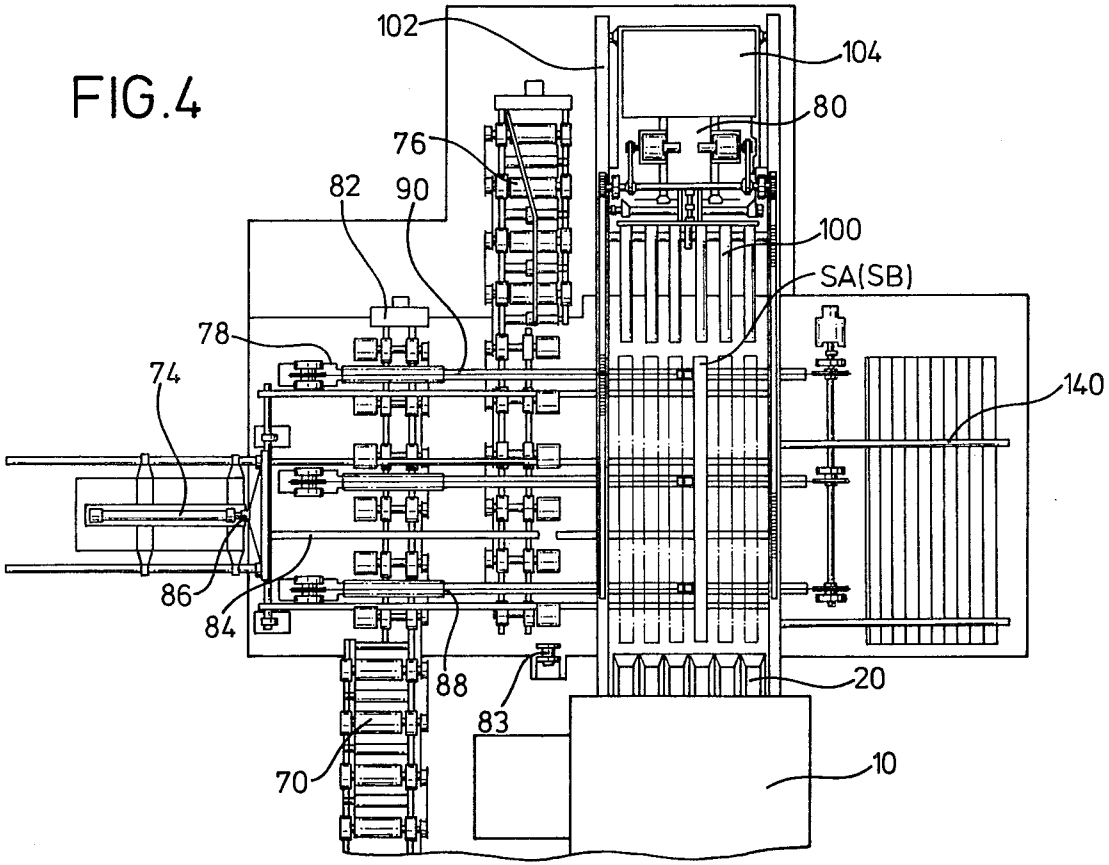
FIG. 4 is a plan view of a conveyor means with a feed roller-table and a charging means arranged in the vicinity of the inlet of the soaking furnace.

In FIG. 3, the reference numeral 10 shows a soaking furnace provided with a heat source 12 such as a plurality of oil burners to bring the soaking treatment of the steel pieces S. The furnace wall 14 and a bed 16 of the furnace 10 are constituted by stacked refracory bricks. In the wall 4 is provided a burner 18. In the bed 16 are provided a plurality of troughs 20 of substantially trapezoidal section, extending longitudinally in parallel to form a corrugated bed. In FIG. 3 there are provided six troughs 20 each of which receives the steel pieces, although the number of troughs is not restricted but may optionally be selected depending on the heat capacity of the soaking furnace 10 as well as on the predermined time for the soaking treatment.

The refractory brick of the bed 16 is essentially made of the corhart brick or an electrofused refractory mullite brick. The bottom width of the troughs 20 is not less than that of the steel piece S of substantially square-section and to be subjected to the soaking treatment. The steel pieces except the bottom surface thereof is well exposed to an adequate heat radiation in the soaking furnace 10 so that the steel piece S is usually heated to the temperatures of 1,100° to 1,200° C.

Figure 1:
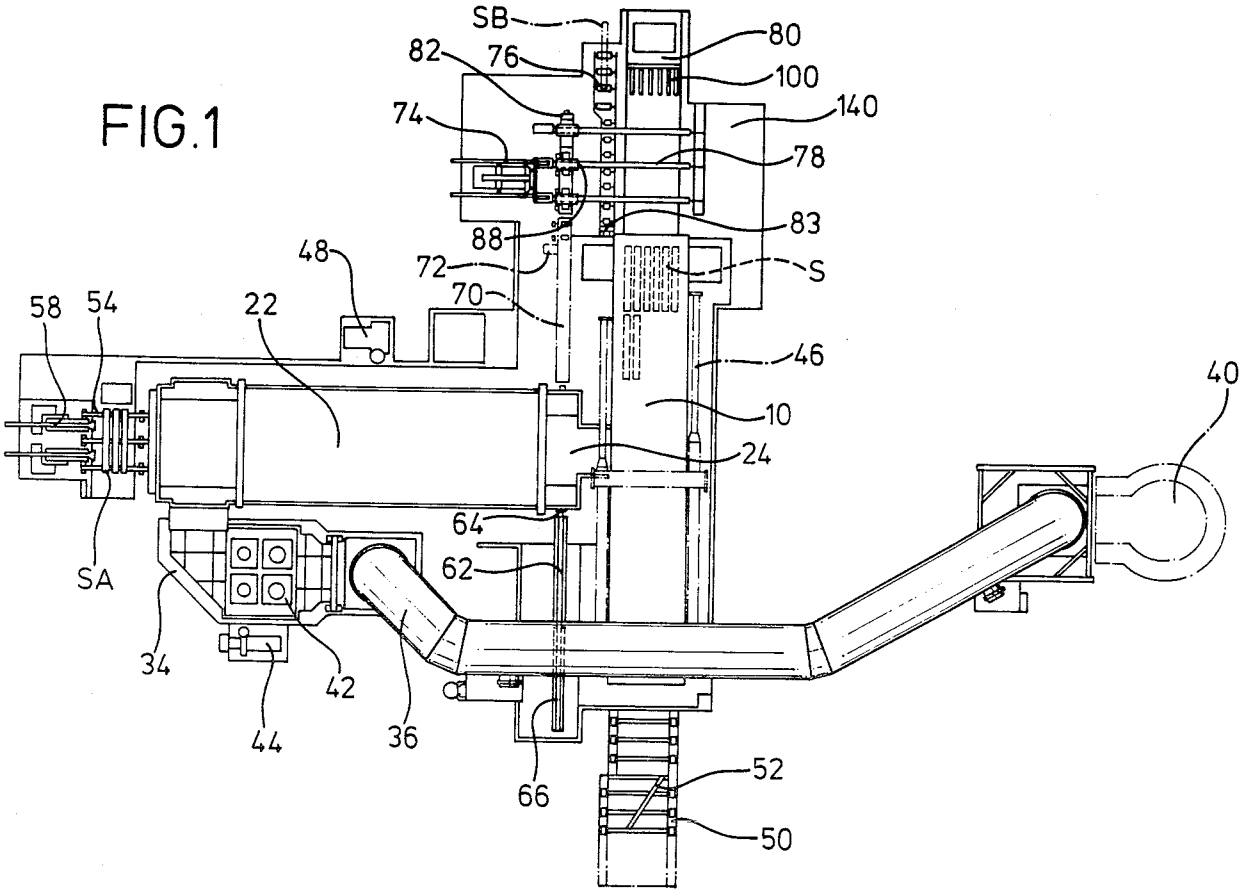
FIG. 1 is a bird's eye view of the apparatus according to the invention.
Figure 2:
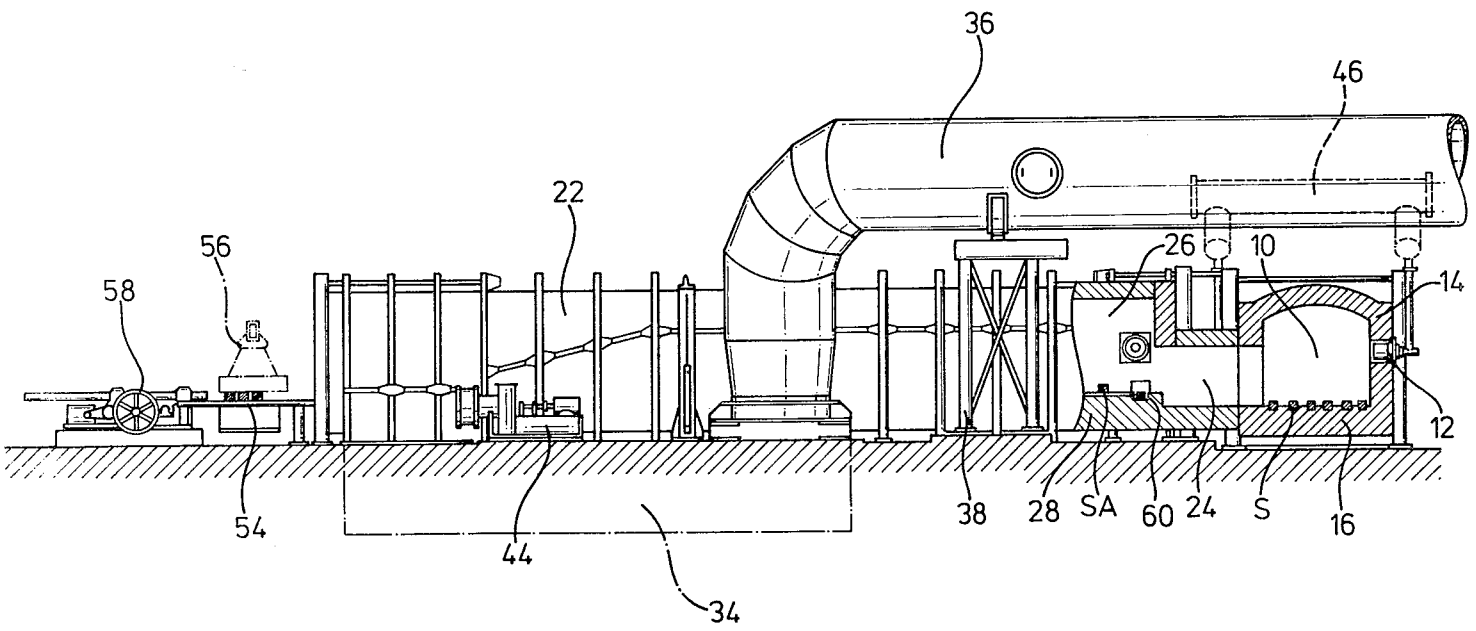
FIG. 2 is a front elevation with partially sectioned of the apparatus FIG. 1.

In abutting and normal relation to the soaking furance 10 is arranged a preheating chamber 22 for preheating the cold steel pieces SA which are stored outside the apparatus and the preheating chamber 22 is communicated with the soaking furnace 10 through a small flue 24 through which a part of the hot gas in the soaking furnace 10 flows into the preheating chamber 22. The small flue 24 is communicated at its one end with a middle portion of the soaking furnace 10 and at its opposite end with an outlet of the preheating chamber 22, as best shown in FIG. 1. The furnace 10, the chamber 22 and the small flue 24 are arranged so as to form a T shape as shown in FIG. 1, although they may be arranged to form another shape, for example a L shape when desired. This normal relation in arrangement between the furnace 10 and the chamber 22 serves to simplify the transfer of the cold steel pices SA since no turning movement of the ojects is required but a mere vertical or horizontal movement of the article is sufficient. Namely, the cold steel piece SA is at first crossfed in the preheating chamber 22 and then pushed vertically at the outlet of the chamber 22 for entering into an inlet of the soaking furnace 10 with crossfeed movement for some distance, and finally transferred in the longitudinal direction in the soaking furnace 10. It will be appreciated that the T shape arrangement between the furnace 10 and the chamber 22 ensures the most efficient flow of the hot gas from the furnace 10 into the chamber 22.

The wall 26 and the bed 28 of the preheating chamber 22 are made of the same refractory brick as that of the soaking furnace 10 and the bed 28 is provided a plurality of tracks 20 extending longitudinally in parallel from the inlet to the outlet of the chamber 22. At the upper portion of the wall 26 are arranged a plurality of openings 32 for receiving oil-burners for additional heating to enhance the preheating capacity of the chamber 22.

As hereinbefore described, since the preheating chamber 22 is communicated with the soaking furnace 10 through the small flue 24, a portion of the heat is transmitted smoothly from the furnace 10 through the flue 24 into the chamber 22. Then the hot gas is moved from the outlet to the inlet of the preheating chamber 22 and is introduced through an underground flue 34 constructed in the vicinity of the inlet of the chamber 22 into an over-ground flue 36 laid on a base frame 38 which is constructed near the preheating chamber 22 and finally is exhausted into atmosphere through a big chimney 40 arranged near the soaking furnace 10. For the purpose of an effective utilization of the residual heat of the exhausted gas in the underground flue 34, the latter may be provided with an air-preheater 42 and a compressor 44, so that a hot air may be fed to the heat source 12 through a blower tube 46 arranged in alignment with the soaking furnace 10.

In FIG. 1, the reference numeral 48 represents a compressor arranged in abutment with the preheating chamber 22 for supplying a fresh air to the oil-burners for additional heating of the preheating chamber 22 when desired and the reference numeral 50 denotes a roller-table arranged at the outlet of the soaking furnace 10 for guiding the soaked steel pieces to the rolling mill (not shown) by means of a swingable guide rod 52.

At the inlet of the preheating chamber 22 is disposed a charging trestle 54 on which is placed each piece of the cold steel pieces SA supplied through a crane 56 from the storing position in such a way that an axis of the cold steel piece SA is normal to a direction of movement thereof in the preheating chamber 22. Behind the trestle 54 is provided a crossfeed means 58 to push the cold steel pieces SA into the preheating chamber 22 for subsequent sliding toward the outlet of the preheating chamber 22. While the cold steel piece SA is transferred along the tracks 30 in a crossfeed manner in the preheating chamber 22, all surface of the cold steel piece SA is exposed to the heat radiation so that the steel piece is preheated to the temperature of approximately 800° to 950° C.

At the outlet of the preheating chamber 22, there is provided a rotating groove 60 which is in normal to the feeding direction of the cold steel pieces SA as best shown in FIG. 3, so that the cold steel piece SA falls into the ground 60 with rotating for 90° about its central axis. As a result, the surface of the steel piece SA contacting with the tracks 30 is raised to face with the side wall of the groove 60, as also best shown in FIG. 3.

In abutting relation to the outlet of the preheating chamber 22 is arranged through the wall 26 a pushing means 62 which reciprocates to push individual steel piece longitudinally along the groove 60. Namely, this pushing means 62 is disposed in juxtaposition into the soaking furnace 10. The pushing means 62 is provided at its top end with an air-cooled pushing head 64 which is movable through a cylinder 66 under the hydraulic pressure to push the preheated and rotated steel piece SA out of an opening 68 of the preheating chamber. As best shown in FIG. 1, in contrast to the pushing means 62 and along the soaking furnace 10, there is extended a roller conveyor 70 which is driven by a motor 72. The preheated steel piece SA is transferred longitudinally on the conveyor 70 driven by the motor 72 until it reaches to the vicinity of the inlet of the soaking furnace 10.

In the vicinity of the inlet of the soaking furnace 10 there are arranged several elements including a terminal of the conveyor means 70 at which the preheated and transferred steel piece SA is withheld, a pushing means 74 which pushes the steel piece SA to a rotation means for further rotation of the piece about its central axis for 90°, a feed roller-table 76 which supplies hot steel SB from the ingot-making position, a crossfeed means 78 which carries the steel pieces SA and/or SB to the inlet position in alignment with the troughs 20 in the soaking furnace 10 and a charging means 80 for pushing the steel pieces into the soaking furnace 10.

To the terminal of the conveyor means 70 is fixed a stopper 82 by which the preheated steel piece SA carried from the preheating chamber 22 is prevented from further moving.

The terminal of the conveyor means 70 is placed in an abutting and parallel relation to the soaking furnace 10 as shown in FIG. 1. Further, the feed roller-table 76 is arranged between the terminal of the conveyor means and the inlet of the soaking furnace 10 to intersperse the hot steel piece SB when desired, directly or indirectly from the ingot-making position (not shown) and carry individual hot steel piece SB in parallel to the cold steel piece SA.

Figure 5:
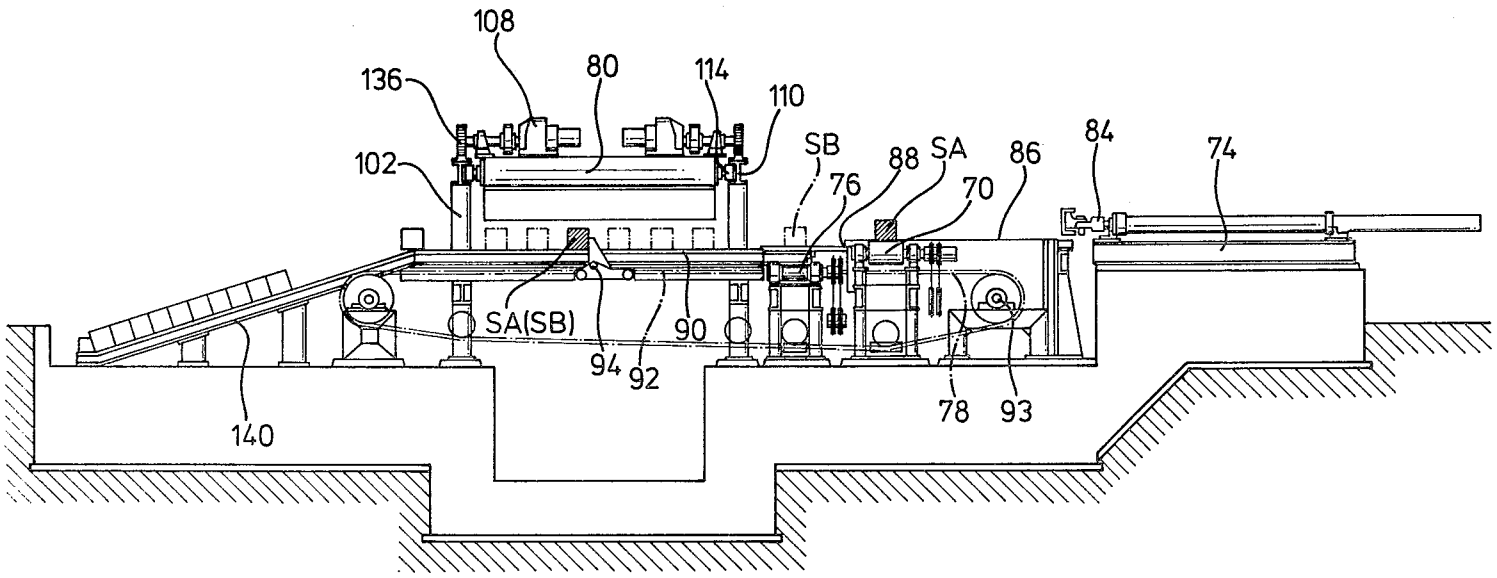
FIG. 5 is a lateral view of the apparatus of FIG. 4.

Behind the terminal of the conveyor means 70, as best shown in FIGS. 1 and 5, is arranged the pushing means 74 having a rod 84 which reciprocates under the hydraulic pressure to push the steel piece. Futher, at the terminal of the conveyor means 70 is arranged a slide rack 86 which comprises a plurality of aligned rails. The slide rack 86 extends in normal relation to the conveyor means 70 and in the same level as that of the conveyor means 70. The preheated steel piece SA when pushed by the rod 84 slides on the slide rack 86 and rotates again about its central axis for 90° by a second rotation means 88 formed at the end of the slide rack 86 as a step downed from a plane of the slide rack 86. As hereinbefore described, since the steel piece SA has been already rotated at the first rotation means for 90°, the steel piece SA is rotated in total for 180° at the second rotation means. Thus, it will be appreciated that the bottom surface of the steel piece SA in the preheating chamber 22 comes to the top surface.

In the embodiment shown in FIG. 6, the second rotation means 88 is formed with a difference in height between the slide rack 86 and a transfer frame 90 as hereinafter fully described.

Figure 6:
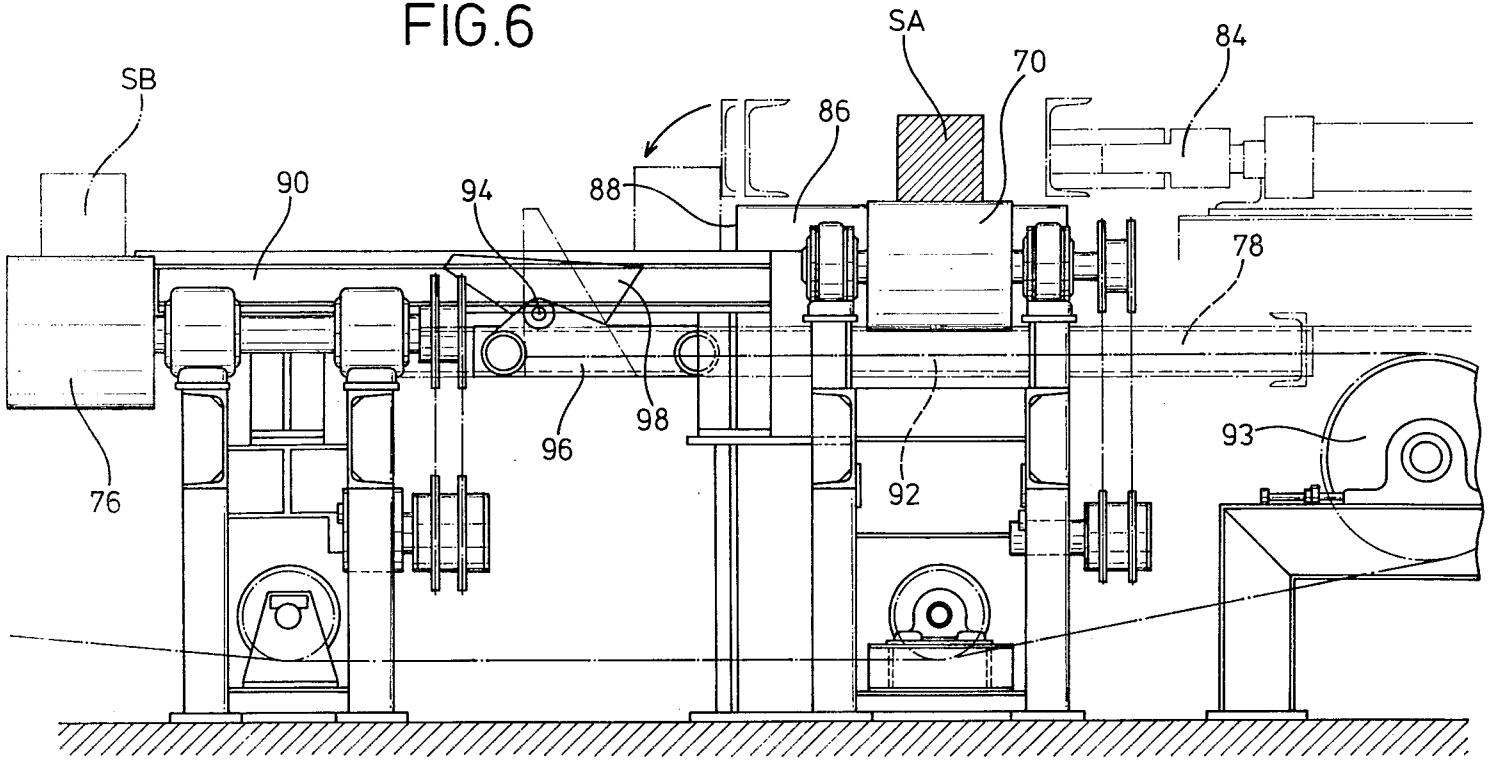
FIG. 6 is a lateral view of the roration means with the crossfeed means.

A second crossfeed means 78 is extended to the inlet of the soaking furnace 10, as shown in FIGS. 1 and 6 and is comprised of a feed frame 90 and a plurality of transfer lines 92. The feed frame 90 includes a plurality of skid-rails arranged in alignment and the second rotation means 88 is disposed between the feed frame 90 and the conveyor means 70. The transfer lines 92 are movable forward and backward in normal to the direction of the transfer of the steel piece S in the soaking furnace by menas of a driving source 93 such as a motor with a plurality of foldable chain hooks 94 adapted to engage with the steel pieces.

When the slide rack 86 is not provided in the pusher 74, the feed frame 90 is directly connected to the upper surface of the conveyor means 70 through the second rotation means 88. On the other hand, when the slide rack 86 is used, the feed frame 90 is connected indirectly to the upper surface of the conveyor means 70 through the slide rack 86 as shown in FIG. 6. In any way, the terminal of the feed frame 90 is extended to the farmost troughs 20 in the soaking furnace 10 and is intersected with the feed roller-table 76. The transfer lines 92 are moved by a sprocket wheel and a tension gear along the feed frame 90 from the front position to the rear position so as to crossfeed the steel pieces to the inlet of the soaking furnace 10 in alignment with the troughs 20. The steel pieces SA and SB are optionally interspersed and controlled automatically or manually to arrive at a predetermined position in the inlet of the soaking furnace 10.

Individual chain hook 94 of the transfer lines 92 is arranged between the chain blocks in the convenient positions and includes a receiving block 96 connected to the chain block and a hook 98 foldably pivoted to the receiving block 96. The hook 98 is of substantially triangle shape in cross section and stands up in case of the forward movement of the transfer lines 92 (counterclockwise direction as shown in FIGS. 5 and 6) while it lies down to the forward direction in case of the backward movement thereof. Thus, in case of the forward movement of the transfer lines 92, the hook 98 is raised in contact with the lateral surface of the steel piece for moving thereof into the inlet of the soaking furnace 10. On the other hand, in case of the backward movement, the hook 98 is pushed downwardly to the left as best shown in FIG. 6 by certain obstacles such as the subsequent steel piece SA or SB or by a pusher-head 100 of the charging means 80. Such the folding movement of the hook 98 may be carried out by a momental difference due to the triangle shape of the hook 98 or by a mechanical manner such as a spring or a lever or with the pneumatic or hydraulic pressure through an aperture to be provided for the receiving block 96.

Figure 7:
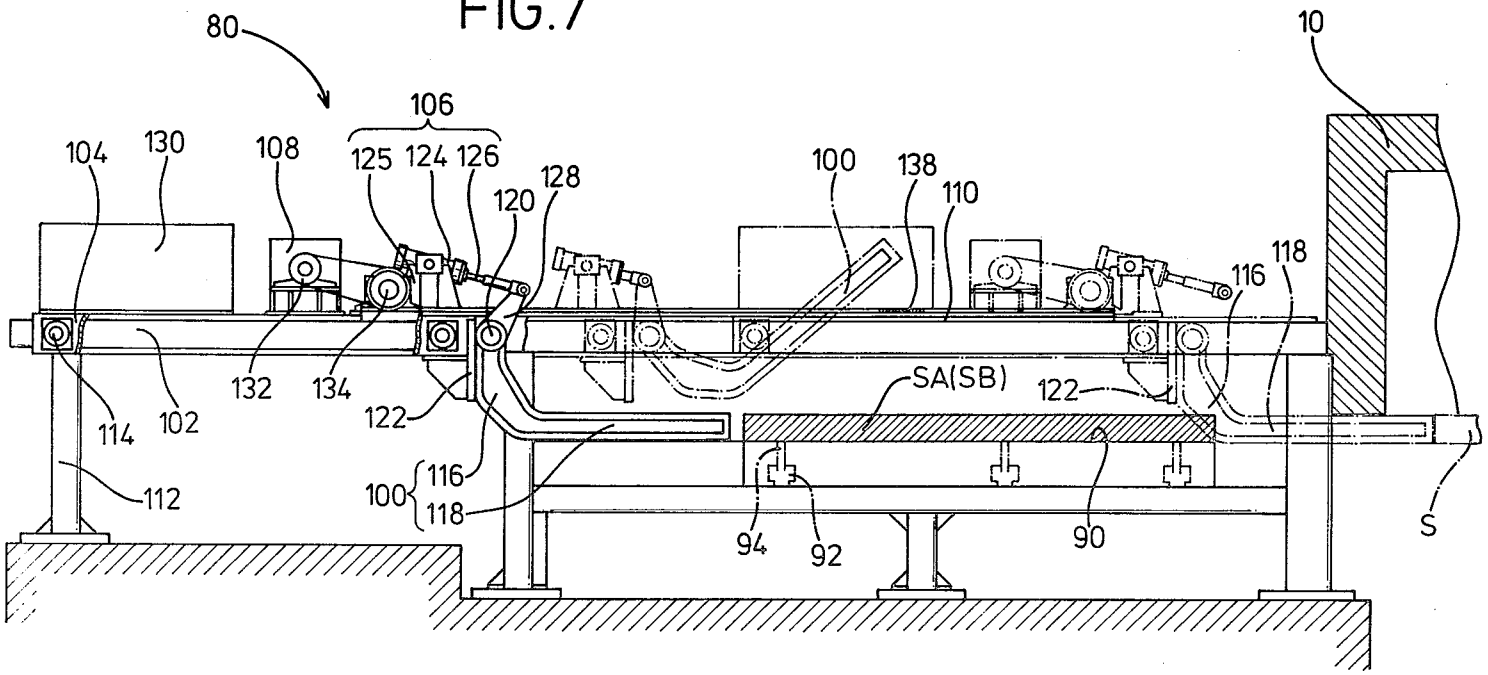
FIG. 7 is a lateral view of the charging means.

In FIG. 7, the three transfer lines 92 are arranged in alignment although more than four transfer lines may be employed and in some designs the single or two transfer lines may also be used if the cold steel piece SA or the hot steel piece SB is crossfed without any rotation. The width of the second crossfeed means 78 may preferably be enlarged in order to transfer the steel pieces of different lengths.

In the embodiment illustrated in FIG. 6, the feed roller-table 76 arranged in normal to the feed frame 90 and in the same plane so that the preheated steel piece SA on the conveyor means 70 and the hot steel piece SB on the feed roller-table 76 may either or alone be crossfed by the common crossfeed means 78 for simplification of the arrangement. However, the arrangement of the conveyor means 70, the feed roller-table 76, the second crossfeed means 78 and the like is not restricted to the illustrated embodiment.

The steel pieces withheld at the predetermined position on the feed frame 90 are charged into the soaking furnace 10 by the charging means 80 which is automatically moved in the longitudinal direction of the soaking furance 10. For this purpose, the charging means 80 is comprised of a rail frame 102, a vehicle 104 running thereon, a plurality of pusher-heads 100 relievably and swingably attached to the front of the vehicle, a swing mechanism 106 such as a pneumatic cylinder for relievably swinging the pusher-heads 100 along the rail frame 102 and a driving mechanism 108 such as a hydraulic motor mounted on the vehicle 104 for moving thereof.

The rail frame 102 is extended along the same direction as the direction of transfer of the steel piece to the inlet port of the soaking furnace.

The rail frame 102 is positioned in normal to the feed frame 90 and includes a pair of H shape rails 110 which are laid on a plurality of supports 112 arranged in the front of the soaking furnace 10 as shown in FIG. 7. The width between the rails is not less than that of the soaking furnace 10 and particularly the total width of the whole paralleled troughs 20. The rails 110 have such a height that a tip of the pusher-head 100, when fallen down, is made into contact with an end face of the steel piece on the feed frame 90. Thus, the steel piece is pushed by the pusher-head during the forward movement of the vehicle 104. However, the pusher-head 100 when lifted does not contact with the steel piece as best shown in FIG. 7.

The vehicle 104 is constructed, for example, by assembling shape steels of convenient shape into a lattice form and is placed on the rail frame 102 by inserting four corner elements 114 into the grooves of the rails 110 as shown in FIGS. 5 and 7.

Figure 8:
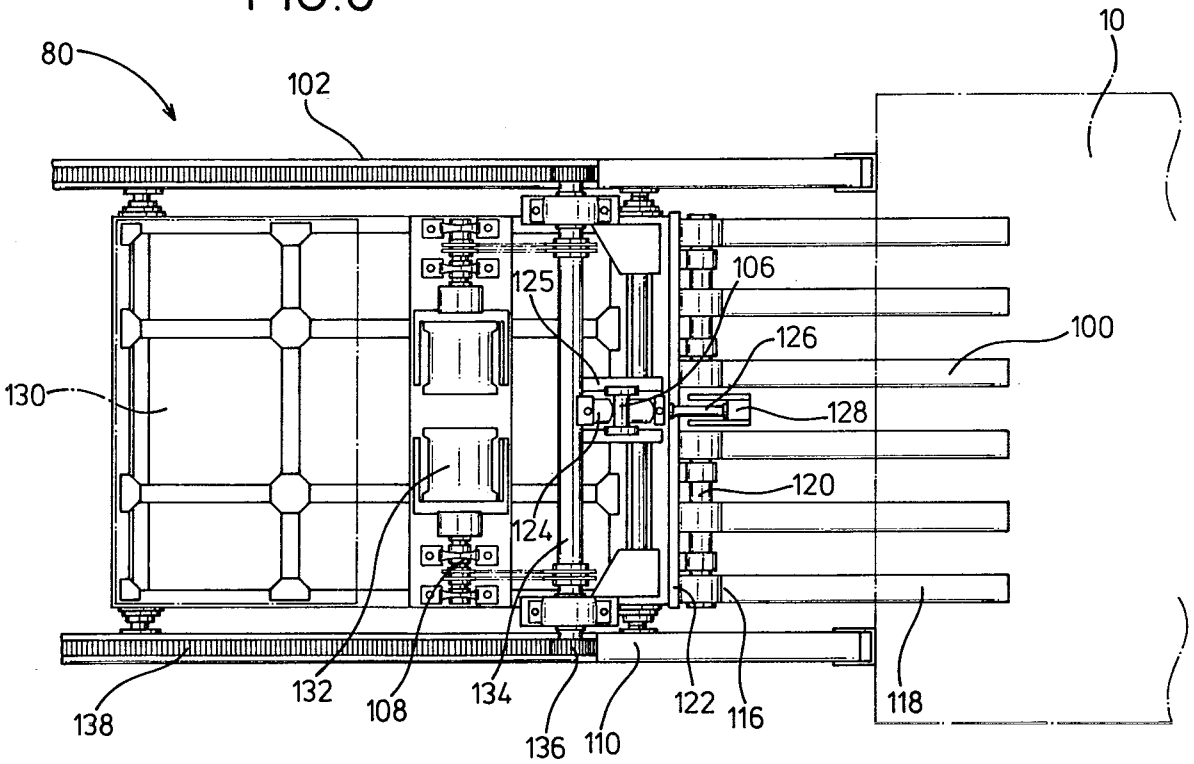
FIG. 8 is a plan view of the charging means of FIG. 7.

In FIG. 8, the six pusher-heads 100 are illustrated to correspond to the six paralleled troughs 20 arranged in the soaking furnace 10. Individual pusher-head 100 is formed into a substantial L shape body, with a fixing member 116 and a pushing rod 118. The upper end of the fixing member 116 is fixed to a swing shaft 120 pivoted to the swing mechanism 106 and the front end of the pushing member 118 or the free end of the pusher-head 100 is made into contact with the steel piece.

As apparent from FIG. 7, the corner of the L shape body of the pusher-head 100 may preferably be cut off in such a way that the cut line becomes parallel to the feed frame 90 or the steel piece when the pusher-head 100 is lifted so that the steel piece may be conveniently passed under the pusher-head. Thus, the height of the rail frame 102 may be reduced as low as possible and as a result the swing range of the pusher-head 100 may be reduced.

In front of the vehicle 104 is suspended a blocking plate 122 which is made into contact with a rear face of the fixing piece 116 of the pusher-head 100 to prevent the downward relief of the pusher-head 100 when the cold steel piece SA or the hot steel piece SB is charged into the soaking furnace 10.

The pusher-head 100 may be of any shape such as a triangular or a rod like shape provided that the pusher-head 100 has a strength sufficient enough to endure the load of the steel pieces on transportation in series in the soaking furnace and has such a size which permits the steel piece to pass when the pusher-head 100 is lifted.

The swing movement of the pusher-head 100 is brought by means of the swing mechanism 106 fixed to the front of the vehicle 104. The swing mechanism 106, as illustrated in FIG. 7, is comprised of an air-cylinder which includes a cylinder 124 and a rod 126. The cylinder 124 is pivoted between a pair of support frames 125 at the front center of the vehicle 104 and reciprocates the rod 126 which is linked to an intermediate member 128 secured to the swing shaft 120. The operation of the swing mechanism 106 is associated with the forward or backward movement of the vehicle 104. Thus, when the vehicle 104 is moved toward the soaking furnace 10, the rod 126 of the swing mechanism or air-cylinder 106 is stretched to move the swing shaft 120 through the intermediate member 128 to retract the pusher-head 100 making the tip of the pusher-head 100 into contact with the steel piece for charging the same into the soaking furnace 10. On the contrary, when the vehicle 104 is moved backward apart from the soaking furnace 10, the rod 126 enters into the cylinder 124 thereby to move the pusher-head 100 in the lifted position.

A plurality of the pusher-heads 100 may be secured in parallel to the single swing shaft 120 as shown in FIG. 8, so that they may be moved together by the single swing mechanism, resulting in obtaining a simple construction with high efficiency and convenient maintenance and inspection.

The forward movement of the vehicle 104 permits the pusher-head 100 to pass the steel pieces into the soaking furnace 10. The high temperature atmosphere in the soaking furnace 10 makes it difficult to arrange any transportation means therein, so that the steel pieces in the soaking furnace are pushed ahead in series by the pusher-head 100 and are finally pushed out of the soaking furnace 10 seriatim. Accordingly, the vehicle 104 must have a power sufficient enough to push all the steel pieces from the inlet port to the outlet of the soaking furnace 10.

Preferably, a convenient hydraulic motor is employed as the driving mechanism 108 in order to avoid a slippage or an idle-running of the vehicle 104 and also to avoid any interruption of the operation due to the over load of the steel pieces S. This driving mechanism includes an oil unit 130, a a pair of hydraulic motors 132 arranged at the opposite sides of the vehicle 104 and a running shaft 134 having wheels 136 which are engaged with the rail frames 102. The running shaft 134 is rotatably journaled by the vehicle 104 to rotate through the chain transmission from the motor shaft. Each wheel 136 is provided with a gear to coact with a rack 138 formed on the upper surface of the rail 110 of the rail frame 102. Thus, the driving force obtained by the hydraulic motor 132 positively advances the vehicle 104 under the resistance of the load of the steel piece S.

The charging means 80 and the second crossfeed means 78 are controlled so that the steel pieces are crossfed at least by the crossfeed means 78 before the forward movement of the charging means 80 is commended. In order to avoid cooling of the steel pieces before entering into the soaking furnace 10, the preheated steel pieces may preferably be charged quickly into the soaking furnace 10.

For the foregoing purpose, the second crossfeed means 78 moves the steel pieces to the inlet of the soaking furnace 10, while the charging means 80 per se is returning to its stating position. On the contrary, the charging means 80 moves the steel pieces into the soaking furnace 10, while the crossfeed means 78 is returning to its starting position. In other words, there is provided such the control cycle that the backward movement of the second crossfeed means 78 is carried out in synchronous with the forward movement of the charging means 80, and vice versa. In particular, while the charging means 80 is moving backward, the pusher-head 100 is raised to form the space which permits passing of the steel pieces, so that the crossfeed means 78 moves the steel pieces to the predetermined position on the feed frame 90 at the entrance of the soaking furnace 10. On the contrary, while the charging means 80 is moving forward with the backward movement of the crossfeed means 78 to its starting position, the chain hooks 94 of the transfer lines 92 takes the fallen position when the crossfeed means 78 comes into contact with the hot steel piece SB which is transferred on the feed frame 90 or practically on the feed roller table 76.

The reference numeral 140 represents a pass line arranged in confront to the pushing means 74 as illustrated in FIG. 1 and the upper surface of the pass line is connected to the upper surface of the feed frame 90 of the crossfeed means 78. The pass line 140 temporally holds, for example when the operation of the rolling mill is discontinued due to unexpected accident, the preheated steel pieces SA or the hot pieces SB supplied by the crossfeed 78 across the inlet path to the soaking furnace 10, thereby to ensure further continuation of the preheating or ingot-making operation.

Hereinafter, the procedures for soaking the cold steel pieces SA stored outside the apparatus and/or the hot steel pieces SB delivered from the ingot-making position will be fully described.

In normal to the preheating chamber the cold steel piece SA is placed by means of the crane 56 on the charge trestle 54 arranged at the entrance of the preheating chamber 22 and is then crossfed into the chamber 22 by means of the pushing means 58 for further transfer through the preheating chamber in which steel piece SA is preheated to 800°–950° C. with the heat introduced from the soaking furnace 10 through the small flue 24. Thereafter, the steel piece SA rotates about its central axis by 90° at the first rotation means 60 arranged in the outlet of the preheating chamber 22. Then the preheated steel piece SA is pushed out of the groove 60 through the opening 68 onto the conveyor means 70 juxtaposed to the soaking furnace 10 for transfer until it is withheld in the vicinity of the inlet of the soaking furnace 10 by means of the stopper 82 arranged at the terminal of the conveyor means 70.

The steel piece SA placed on the terminal of the conveyor means is further pushed by the pushing means 74 onto the slide way 86 to rotate further by 90° at the second rotation means 88 for placement on the feed frame 90 of the second crossfeed means 78.

Meanwhile, the hot steel piece SB, which has been manufactured in the ingot-making factory, is transported on the feed roller-table 76 arranged in parallel to the conveyor means 70 until it is withheld by the stopper 82 on the feed roller-table 76 arranged in parallel to the cold steel piece SA. Thus, the cold and hot steel pieces SA and SB are interspersed here since the feed roller-table 76 and the feed frame 90 have the common upper surface.

When the second crossfeed means 78 is commenced to operate, the chain hook 94 of the transfer lines 92 moves the steel piece SA or SB on the feed frame 90 until it is withheld at the predetermined position in the entrance of the soaking furnace 10 in alignment with the paralleled throughs 20. Even when the steel piece SA or SB on the feed frame 90 is transported seriatim, the transfer of the steel piece can be carried out rapidly without any spontaneous cooling.

The charging means 80 then moves forward with the pusher-heads 100 in the fallen position and contacting with the steel pieces for entering into the soaking furnace 10. After the charging cycle is terminated, the charging means 80 moves backward with pusher-heads 100 in the lifted position to wait at the rear position of the rail frame 102 until the next charging cycle. Meanwhile, the transfer lines 92, which has returned to its starting position during the forward movement of the charging means 80, moves the steel pieces into the inlet of the soaking furnace 10. These operations are repeated to charge the steel pieces SA and/or SB successively into the soaking furnace 10.

The charging and soaking of the steel pieces are carried out in the following way. Namely, the steel pieces are placed in the troughs 20 seriatim from the inlet to the outlet of the soaking furnace 10 and then pushed by the succeeding steel pieces carried by the charging means 80 and finally delivered from the soaking furnace seriatim onto the roller-table 50 arranged at the delivery thereof. In the soaking furnace 10, the steel pieces are heated to the temperatures of 1,100°–1,200° C. by means of the heat source 12 such as an oil-burner as already described. The retention time in the furnace 10 may preferably be prolonged as long as possible to ensure the positive soaking result because the steel pieces S are charged into and out of the furnace 10 seriatim depending on the number of the troughs 20.

From the foregoing description, it will be appreciated that a portion of the heat from the soaking furnace 10 may be advantageously utilized for preheating the cold steel pieces SA in the preheating chamber 22.

The preheated steel piece SA is rotated by 90° at the first rotation means arranged at the delivery of the preheating chamber 22 and is further rotated by 90° at the second rotation means 88 in the same direction when the piece is transferred from the conveyor means 70 to the feed frame 90 of the second crossfeed means 78, so that the total rotation angle sums up to 180°. Namely, the steel piece is completely reversed. As a result, the bottom surface of the steel piece contacted with the bed 28 of the preheating chamber 22 is turned to the upper surface before the steel piece is introduced into the soaking furnace 10. Thus, the rotation of the steel piece by 180° prevents uneven heating with minimum development of oxidized layer.

As hereinbefore described, the troughs 20 arranged in the soaking furnace 10 is formed into the trapezoidal shape in cross section, so that the steel piece may be more exposed to the heat radiation than that of the square shape in cross section since a clearance is formed between an inclined surface of the trough and the vertical wall of the steel piece and the latter is therefore whole exposed to the heat radiation.

In other words, individual steel piece S is heated in the soaking furnace 10 in such a manner that either lateral surfaces of the steel piece are exposed to the heat radiation along the sloped walls of the trough 20 and the upper surface thereof is exposed directly to that from the heat source and only the bottom surface is subjected to the heat transfer from the preheated chamber bed 16. According to the construction of the invention, several advantages such as reduction in the soaking time, suppression of production of the oxidized layer, improvement in the quality of the product in the rolling mill and increase of the product yield may be achieved.

In the vicinity of the inlet of the soaking furnace 10 may be interspersed the cold steel pieces SA from the preheating chamber 22 and the hot steel pieces from the ingot-making position or either the hot or cold steel pieces may be treated in the soaking furnace 10 depending on the operational condition, so that the steel pieces may be supplied to the subsequent rolling mill without interruption thereby to ensure the continuous operation in the rolling mill with reduction of the running cost.

Further, since the soaking furnace 10 is communicated with the preheating chamber 22 through the small flue 24, a portion of the heat from the furance 10 may be utilized as the heat source for the preheating chamber 22 with reduced fuel consumption and improved heat efficiency.

The delivery section of the preheating chamber 22 is maintained at a relatively high temperature by the heat from the soaking furnace by the heat from the soaking furnace 10 although the temperature at the inlet section of the preheating chamber 22 is rather low, so that the preheating treatment of the cold steel piece is commenced at a relatively low temperature in order not to deteriorate the composition of the cold steel pieces SA. Further, since the preheated steel piece SA is rotated about its central axis by 180° on transportation thereof from the preheating chamber to the inlet of the soaking furnace, the uniform soaking treatment may be achieved. As a result, production of the oxidized layer could be extremely suppressed.

When the hot steel pieces SB are treated together with the cold steel pieces SA, the latent heat of the hot steel piece SB may be advantageously utilized as an additional heat source in the soaking furnace 10, so that the heat capacity of the main heat source 12 may be reduced with the shortened soaking time, resulting in the reduction of the fuel consumption. Since the fuel consumption is considerably reduced, a total amount of the emitted nitrogen oxides and sulfur oxides is also reduced. As a result, an environmental pollution may be prevented and the cost of countermeasure therefore may be alleviated.

According to the construction of the apparatus of the invention, the elements 58, 62, 74, 76 and 80 are simple and a series of operation may be effected very smoothly as the steel pieces are never subjected to the turning movement. Furthermore, since the steel pieces slides directly on the beds 16 and 28 of the preheating chamber and soaking furnace any specific device for moving the bed is not required, as is required in the conventional walking-beam furnace. Still further, a water-cooling system required as an attachment may be eliminated and the driving means may be simplified. Hence the investment to the equipments could be reduced and the running cost such as power cost could also be reduced.

While certain preferred embodiments of the invention have been illustrated by way of example in the drawings and particularly described, it will be understood that various modifications may be made in the methods and constructions and that the invention is no way limited to the embodiments shown.

What is claimed is:

1. An apparatus for soaking steel pieces comprising a heated soaking furnace having an inlet, an outlet and troughs for guiding the pieces through said furnace, a chamber for preheating cold steel pieces, means for transferring at least a portion of the heat from said furnace to said chamber, said chamber having an inlet for receiving cold pieces, means for moving the cold pieces through said chamber to preheat the same and an outlet in communication with the inlet of said furnace, and means for conveying the preheated pieces from the outlet of said chamber to the inlet of said furnace, whereby said pieces are introduced in preheated condition to said furnace including feed means for cross-feeding said cold pieces to said chamber, normally of the direction of said soaking furnace, means for effecting a translatory change in direction of said cold pieces of 90° on to said means for moving said cold pieces through said chamber, and means for effecting a second translatory change in direction of said cold pieces of 90° from said means for moving said cold pieces on to said conveying means for introduction into said furnace.

2. An apparatus for soaking steel pieces according to claim 1, whereiin said means for transferring said heat from said furnace to said chamber comprises a flue for the exhaust heat of said furnace.

3. An apparatus for soaking steel pieces according to claim 1, wherein the means for conveying said preheated pieces from the outlet of said chamber to said inlet of said soaking furnace comprises a roller-table located at the outlet of said chamber for receiving and moving said preheated pieces, a rotation means provided at the outlet of the preheating chamber for rotating each preheated piece prior to deposition on said conveyor means, another rotation means interposed between the end of said conveyor means and said inlet to said furnace for further rotating each preheated piece about its axis, and transfer means for moving the preheated pieces into the inlet of said furnace.

4. An apparatus according to claim 3, wherein said conveyor means extends normally to the direction of movement of said pieces through said preheating chamber and the transfer means extends perpendicularly to the movement of said pieces through soaking furnace.

5. Apparatus according to claim 4, wherein said conveyor means is located in plane stepped down from the plane of said chamber and in a plane stepped up from the transfer means, said rotation means for rotating said pieces including at least in part the outlet edge of the chamber and the edge of the conveyor means, respectively, rotates said piece by 90°.

6. An apparatus for soaking steel pieces according to claim 1, 3 or 4, wherein said transfer means is in communication with a feed roller-table for supplying hot ingots and for selectively interspersing the preheated pieces with the hot ingots.

7. An apparatus according to claim 3, 4 or 5, wherein the transfer means comprises a crossfeed mechanism comprising a feed frame having an upper surface at the same level of the surface of said movable conveyor and a plurality of driven transfer lines movable normally to the direction of movement of the pieces in the soaking furnace, each of said transfer lines having a plurality of foldable chain hooks engageable with said pieces.

8. An apparatus according to claim 1, wherein said soaking furnace is provided with a heating source in the side wall thereof and a corrugated bed defining a plurality of longitudinal troughs in which said pieces are moved, said troughs being trapezoidal in cross section.

9. An apparatus according to claim 1, further including a charging means which comprises a rail frame, a vehicle movably mounted on said rail frame, pusher-heads swingably attached to the front of said vehicle for passing the steel pieces through the soaking furnace, a swing mechanism for swinging said pusher-heads up and down, and driving mechanism mounted on said vehicle for moving the same.

* * * * *